US005884944A

United States Patent [19]

Durham

[11] Patent Number: 5,884,944

[45] Date of Patent: Mar. 23, 1999

[54] SYSTEMS AND METHODS FOR RECOGNIZING AND REWARDING INDIVIDUAL CONTRIBUTIONS

[76] Inventor: Mark P. Durham, 14450 N. 55th St., Scottsdale, Ariz. 85254

[21] Appl. No.: 865,501

[22] Filed: May 29, 1997

Related U.S. Application Data

[60] Provisional application No. 60/018,660, May 30, 1996.

[51] Int. Cl. [6] ..... B42D 15/00

[52] U.S. Cl. ..... 283/67; 283/81; 283/56; 283/101

[58] Field of Search ..... 283/67, 70, 81, 283/101, 105, 56, 117, 900, 903, 51

[56] References Cited

U.S. PATENT DOCUMENTS

| | | | |
|---|---|---|---|
| 4,307,900 | 12/1981 | Krautsack | 283/56 |
| 4,778,153 | 10/1988 | Bachman et al. | 283/903 X |
| 5,046,737 | 9/1991 | Fienberg | 283/903 X |
| 5,299,834 | 4/1994 | Kraige | 283/51 |
| 5,332,265 | 7/1994 | Groess et al. | 283/56 |
| 5,417,458 | 5/1995 | Best et al. | 283/51 |
| 5,489,123 | 2/1996 | Rushkoft | 283/56 X |
| 5,501,491 | 3/1996 | Thompson | 283/70 |
| 5,531,482 | 7/1996 | Blank | 283/67 |
| 5,775,735 | 7/1998 | Bulnick et al. | 283/900 X |

*Primary Examiner*—Willmon Fridie, Jr.
*Attorney, Agent, or Firm*—Dale E. Hulse; Berne S. Broadbent

[57] ABSTRACT

A method for recognizing and rewarding individual contributions is disclosed as including the steps of: (1) obtaining a recognition assembly adapted to removably retain a retaining member comprising at least one award seal, the award seal having a predetermined value; (2) personalizing the recognition assembly for a qualified recipient; (3) presenting the recognition assembly to the qualified recipient; (4) removing one or more award seals from the retaining member of the recognition assembly; and (5) redeeming one or more award seals for comparably valued merchandise or services. Correspondingly, the step of formulating goals and objectives in an attempt to target certain desirable behaviors from the qualified recipient may be included. Structurally, the recognition assembly may comprise a certificate member formed of a material being sufficiently sturdy for display, an award member including at least one fastening member for removably retaining the retaining member having one or more award seals, and a detachable connection disposed between the certificate and the award member. Alternatively, the recognition assembly may comprise a greeting card having a heading or greeting field, a field for a personalized greeting or message, and/or a field for identifying the person or persons presenting the greeting card.

20 Claims, 3 Drawing Sheets

SYSTEMS AND METHODS FOR RECOGNIZING AND REWARDING INDIVIDUAL CONTRIBUTIONS

BACKGROUND

1. Related Applications

This application claims the benefit of my co-pending U.S. Provisional Application No. 60/018,660, filed on May 30, 1996 for SYSTEMS AND METHODS FOR RECOGNIZING AND REWARDING EMPLOYEE CONTRIBUTIONS.

2. The Field of the Invention

This invention relates to recognition programs and, more particularly, to novel systems and methods for recognizing and rewarding individual contributions.

3. The Background Art

In an age of corporate downsizing and a watchful eye on the financial "bottom line," companies, institutions, government agencies, organizations, etc. (both profit and non-profit) seem to have become more attentive to the individual contributions of employees, associates, independent contractors, and the like who have been hired or engaged to assist in reaching the specific goals and objectives of an organization. Not much development, however, has transpired by those skilled in the art as to recognition or incentive programs to reward and recognize persons for their individual contributions other than those conventional means that may include, for example, discretionary bonuses, stock options, and/or varied participation in profitability pools. These conventional recognition or incentive programs have been found to be generally directed to overall performance, rather than isolated contributions that may be overlooked or underappreciated with the passage of time.

Although various incentive programs have been developed to protect "bottom line" finances, many of the methods and techniques which have been developed by those skilled in the art generally relate to coupon redemption apparatus and programs. For example, prior art coupon redemption apparatus may include sheets of promotional merchandise coupons supportably disposed in relation to a plate-like support member which is adapted for mounting at the front edge of a supermarket shelf to provide a point-of-sale display in association with product or units of the particular product line. Structurally, the promotional coupon may comprise a front surface which illustrates and promotes a particular product line and describes the nature of an offer being made. Typically, the promotional coupon further includes a rear surface that continues with the description of the product line and the offer, but also contains an adhesive region designated for the attachment of a portion of the package dress or packaging material of the specific product or the product line being promoted thereto before redemption may be available.

Another example of a prior art coupon redemption methods and apparatus includes a coupon redemption card formed of a layer of card stock, laminate, and a layer of adhesive, the method comprising the steps of: (1) printing information on a front surface of the layer of card stock, such as, manufacturing, marketing, charity information, and the like; (2) applying the laminate to the front surface; (3) applying the adhesive layer to a back surface of the layer of card stock; and (4) folding the layer of card stock in half, such that one half of the back surface is adhered to another half of the back surface by means of the adhesive layer. As noted by the inventor, this invention overcomes the disadvantages of the prior art by creating a coupon redemption card wherein coupons may be removed from the card with a sufficient layer of the card stock remaining to maintain the support of the coupon redemption card and maintain structural integrity through the life of its use in a wallet-carrying environment.

Similarly, those skilled in the art developed prior art transactional control systems which generally include a set comprising a transactional card and a removable label having a first side suitable for printing indicia thereon and a second side having a reusable adhesive layer suitable for affixing the label to the transactional card. In typical operation, the label printed with registration indicia may be removed from the transaction card and affixed to a registration form to provide instant on-site registration of a holder of the transaction card.

Consistent with the foregoing, while prior art apparatus and methods for coupon redemption and transactional control systems may disclose some of the individual features of the present invention and appear generally suitable for their intended purposes, they nevertheless leave much to be desired from the standpoint of providing a recognition program for recognizing and rewarding the contributions of individuals in an organization or business. In this regard, the present invention provides for novel systems and methods for recognizing and rewarding individual contributions which overcomes several deficiencies of prior art contribution techniques and resolves several problems left unsolved by the known prior art.

BRIEF SUMMARY AND OBJECTS OF THE INVENTION

In view of the foregoing, it is a primary object of the present invention to provide novel systems and methods for recognizing and rewarding individual contributions comprising a document or certificate of achievement or recognition releasably attached to an award member or a greeting card having one or more award seals removably disposed in relation therewith, wherein each award seal comprises a preassigned value which is redeemable for selected merchandise and/or services.

It is also an object of the present invention to provide systems and methods for recognizing and rewarding individual contributions which includes a certificate of achievement or recognition formed of a material sufficiently sturdy to provide structural support to the certificate for display, such as, by way of example, for mounting or framing upon its removable detachment from the award member.

Further, it is an object of the present invention to provide systems and methods for recognizing and rewarding individual contributions which uses a systematic approach and recognition assembly that is easy to understand, implement, and administer, thus providing a simple turn-key recognition program designed to heighten individual awareness and desire to achieve goals and objectives.

Similarly, it is an object of the present invention to provide systems and methods for recognizing and rewarding individual contributions which incites productivity, safety, morale, quality, and an adherence to established policies and procedures.

Additionally, it is an object of the present invention to provide systems and methods for recognizing and rewarding individual contributions incorporating a simple construction having few working parts.

It is likewise an object of the present invention to provide systems and methods for recognizing and rewarding individual contributions which is generally cost effective in relation to mass manufacturing and production.

Consistent with the foregoing objects, and in accordance with the invention as embodied and broadly described herein, a system and method for recognizing and rewarding individual contributions is disclosed in one presently preferred method of the present invention, as including the steps of: (1) obtaining a recognition assembly adapted to removably retain a retaining member comprising at least one award seal having a predetermined value; (2) personalizing the recognition assembly for a qualified recipient; (3) presenting the recognition assembly to the qualified recipient; (4) removing one or more award seals from the retaining member of the recognition assembly, and (5) redeeming one or more award seals for comparably valued merchandise or services. In addition, the presently preferred method for recognizing and rewarding individual contributions may further comprise the step of formulating goals and objectives in an attempt to target certain desirable behaviors from the qualified recipient.

In one presently preferred embodiment of the present invention, the recognition assembly comprises a certificate member, an award member having at least one fastening member providing means for removably retaining the retaining member including one or more award seals, and a detachable connection disposed between the certificate and the award member. In preferred design, the certificate may be formed of a material which is sufficiently sturdy so as to provide means for display, such as being mounted in a frame or other suitable display means. The certificate may further include a title section, a section identifying a qualified recipient, a section for outlining the nature of the recognition, and/or a section for an authorized signature. In yet another presently preferred embodiment, the recognition assembly may comprise a greeting card having a heading or greeting block, a section for a personalized greeting or message, and/or a section for identifying the person or persons presenting the greeting card, if desired.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 4, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
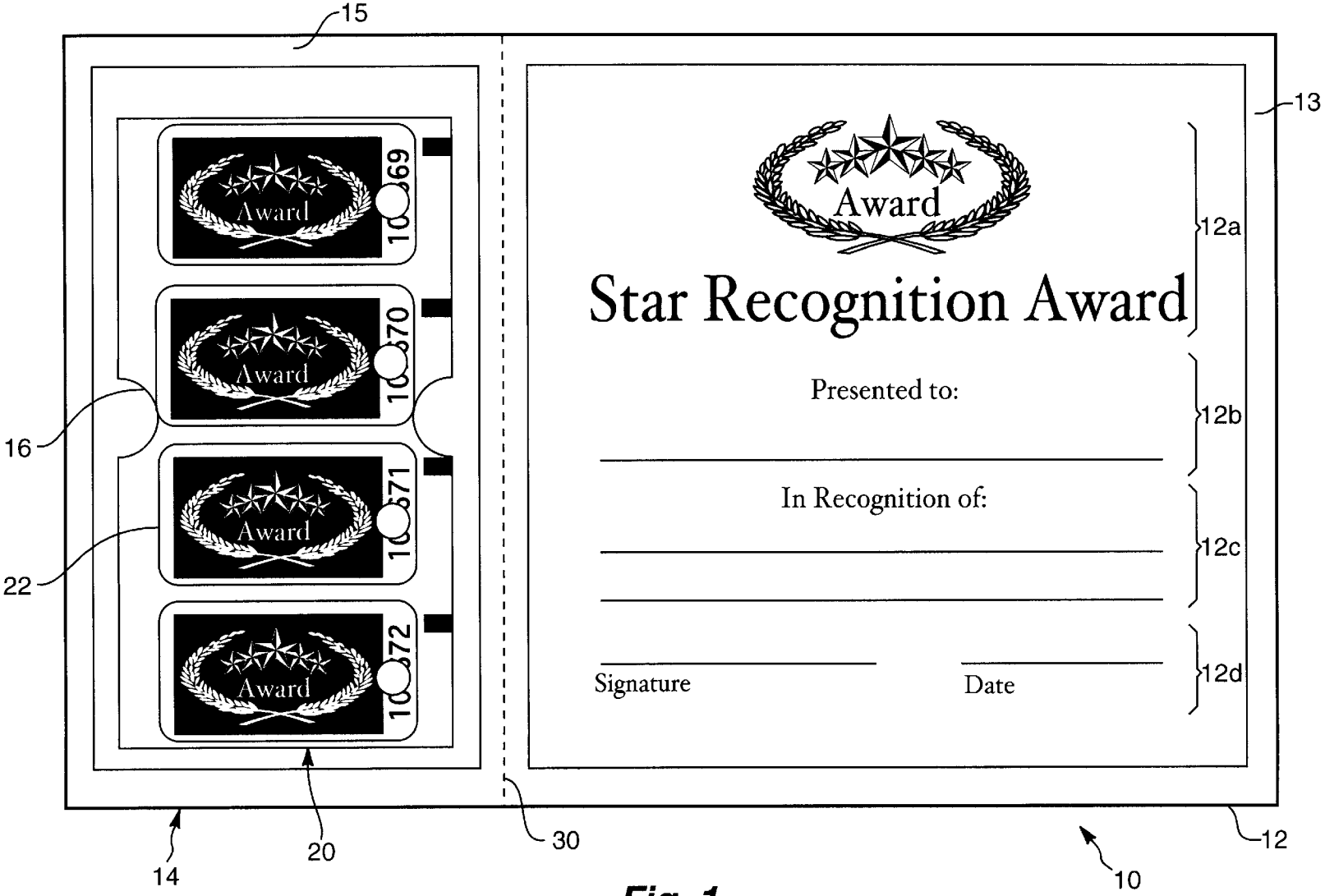
FIG. 1 is a perspective view of one presently preferred embodiment of the systems and methods for recognizing and rewarding individual contributions of the present invention.

One presently preferred embodiment of the recognition assembly of the present invention, designated generally at 10, is best illustrated in FIG. 1. As shown, the recognition assembly 10 comprises a certificate member 12 and an award member 14 operably disposed in connection by a detachable connecting means 30. Disposed in removable engagement with the award member 14 is a retaining member 20 comprising one or more award seals 22. In preferred operation, the connecting means 30 disposed between the certificate member 12 and the award member 14 maintains a unitary relationship therebetween until severed, thereby releasing this operable connection. In this regard, the certificate member 12 may be displayed, if desired, and one or more award seals 22 disposed in relation to the retaining member 20 may be removed and redeemed for selected merchandise and/or services of corresponding value or, in the alternative, saved and introduced into a collection member for accumulating value by means of collecting additional award seals 22.

In preferred construction, the certificate member 12 and the award member 14 may be formed of a material being sufficiently sturdy so as to provide structural support to each member 12, 14. In one presently preferred embodiment of the present invention, the certificate member 12 and the award member 14 may be formed of paperboard. As will be readily appreciated by those skilled in the art, however, heavy stock paper, composition board, card stock, bond paper, or other suitable paper products or materials having sufficient paper weight are possible which are consistent with the spirit and scope of the present invention.

As best illustrated in FIG. 1, the certificate member 12 may be formed having a substantially square or rectangular configuration generally corresponding to the shape of conventional certificates of achievement or recognition, as are readily known in the art. One presently preferred embodiment of the certificate member 12 of the recognition assembly 10 of the present invention may be formed having four equal sides. For example, each side of the certificate member 12 may be formed having a length of approximately 14 cm. Although the certificate member of the present invention is illustrated and described in connection with a generally square configuration comprising a specific size and dimension, those skilled in the art will readily recognize that various other geometrical configurations and/or sizes of the certificate member are possible. The use of a generally square configuration having the dimensions disclosed herein is thus by way of illustration only and not by way of limitation.

To assist in personalizing the certificate member 12 of one presently preferred embodiment of the present invention, the layout of the certificate member 12 may comprise a title section or field 12*a*, a section or field identifying the recipient of the certificate 12*b*, a section or field outlining the nature of the recognition to be provided 12*c*, and/or a signature section or field authorizing the presentation of the certificate 12*d*. It will be readily appreciated, however, that the incorporation of any one of the sections or fields outlined above, or the incorporation of other anticipated sections or fields, or any variation thereof, are possible. In addition, to further personalize the certificate member 12, an outline or framing design 13 may be disposed along the periphery of the facing of the certificate member 12 so as to enhance the aesthetic qualities or characteristics of the certificate member 12, if desired.

Figure 2:
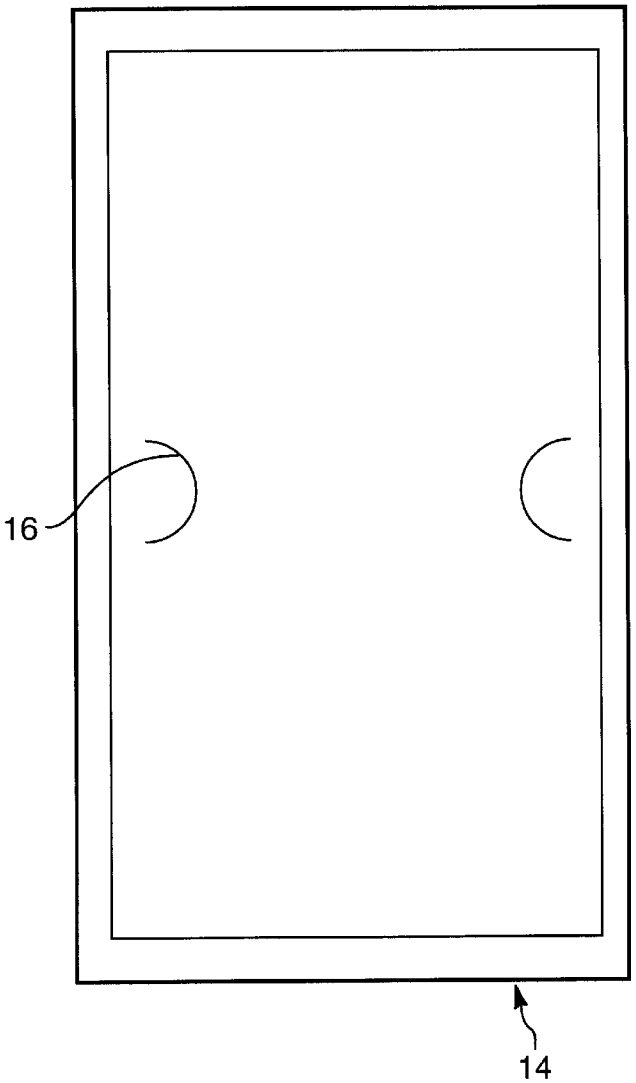
FIG. 2 is a top plan view illustrating a fastening member of the presently preferred embodiment of the systems and methods for recognizing and rewarding individual contributions of FIG. 1.

As best illustrated in FIGS. 1 and 2, the award member 14 may be formed having a substantially rectangular shape being dimensionally sufficient in surface area to removably engage the retaining member 20. For example, one presently preferred embodiment of the award member 14 of the present invention may be formed having two parallel sides having a length corresponding to the length of the corresponding side wall of the certificate member 12. For example, the award member 14 may comprise a first pair of opposing sides having a length of approximately 14 cm and a second pair of opposing sides disposed perpendicular to the first pair of opposing sides having a length of approximately 8 cm.

Although one presently preferred embodiment of the award member 14 is illustrated and described in connection with a generally rectangular configuration comprising a specific size and dimension, those skilled in the art will readily recognize that various other geometrical configurations and/or sizes of the award member 14 of the present invention are likewise suitable. Correspondingly, the use of a generally rectangular configuration having the dimensions disclosed above is thus by way of illustration only and not by way of limitation. Moreover, to further personalize the award member 14, an outline or framing design 15 may be disposed along the periphery of the facing of the award member 14 so as to enhance the aesthetic qualities or characteristics of the award member 14, if desired.

Preferably disposed in connection with the award member 14 are one or more fastening members 16. As best shown in FIGS. 1 and 2, at least two fastening members 16 may be disposed or formed in relation to the surface facing of the award member 14. The fastening members 16 are preferably formed or disposed in relation to the surface facing of the award member 14 in such a manner so as to be adapted to engage the retaining member 20 in a substantially fixed or removable relationship therewith.

In the structural design of one presently preferred embodiment of the present invention, one or more fastening members 16 may be formed as slits, cutouts, tabular members, or the like. As shown, the fastening members 16 may comprise a substantially semicircular configuration, however, other geometrical configurations are possible. It will be apparent to those skilled in the art that other fastening members, devices, mechanisms, and/or configurations thereof may be constructed in accordance with the inventive principles set forth herein. For example, conventional fastening members or adhesives are herein contemplated to fall within the spirit and scope of the present invention. It is intended, therefore, that the examples provided herein be viewed as exemplary of the principles of the present invention, and not as restrictive to any particular structure or structures for implementing those principles.

Figure 3:
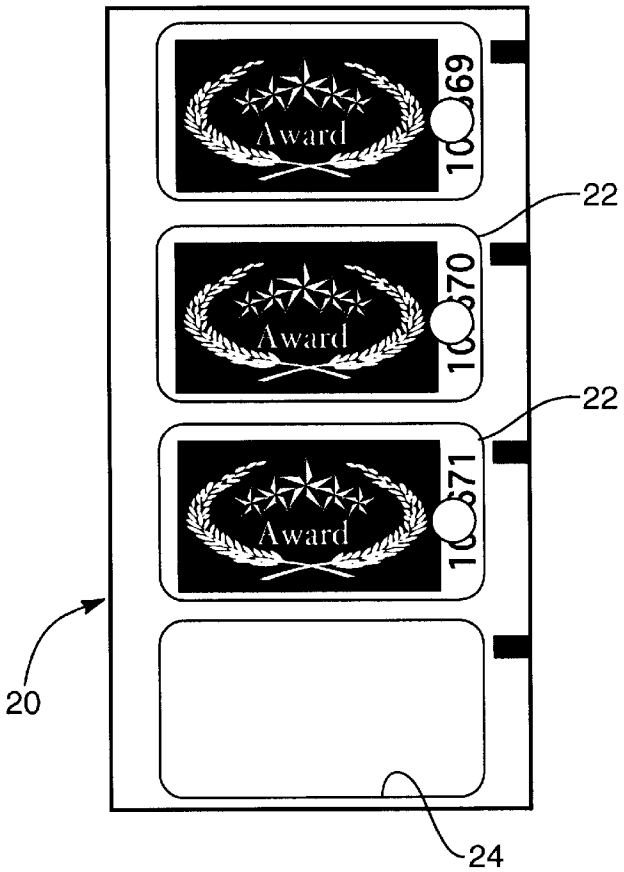
FIG. 3 is a top plan view illustrating a retaining member comprising one or more removable award seals of the presently preferred embodiment of the systems and methods for recognizing and rewarding individual contributions as shown in FIG. 1.

As previously noted, the retaining member 20 may be removably disposed in operable engagement with one or more fastening members 16 of the award member 14. Consistent with this arrangement, the retaining member 20 comprises a means for retaining at least one award seal 22 in relation to the award member 14. In one presently preferred embodiment of the recognition assembly 10 of the present invention, the award seal 22 is preferably formed comprising an adhesive backing which removably engages the front facing 24 of the retaining member 20, as best illustrated in FIG. 3. In operation, after removal of an award seal 22 from the retaining member 20, the award seal 22 maintains its adhesive characteristics for potential placement into a collection member for the purpose of accumulating award seals, if desired.

In preferred design, the award seals 22 may include an identification or serial number for administrative purposes such as, for example, accounting, recording, and/or to prevent the production or counterfeiting of award seals. Similarly, an alternate preferred embodiment of the award seal 22 may include a ticket, coupon, or any other award item suitable for representing value in relation to its redemption for selected merchandise and/or services.

Referring now to FIGS. 1 and 3, the present invention comprises one or more award seals 22 disposed in removable engagement with the retaining member 20. As shown in one presently preferred embodiment of the present invention, the retaining member 20 preferably comprises four award seals 22, each award seal 22 having a predetermined value. As will be appreciated, the award seals 22 may provide various increments of value in light of their inherent redemption or exchange value. For example, the award seals 22 may have incremental values of one, five, ten, or any other predetermined award or exchange value. Consistent with the foregoing, the number of award seals 22 disposed in relation to the retaining member 20, the structural characteristics of the award seals (e.g., adhesive backing), and the possibility of various incremental values assigned to each award seal are not to be considered as a form of limitation in regards to the scope and spirit of the present invention, but rather as only illustrative of one presently preferred embodiment thereof.

As best shown in FIG. 1, a connecting means 30 is operably disposed between corresponding peripheral edges of the certificate member 12 and the award member 14. In preferred operation, the connecting means 30 provides for separating the unitary relationship between the certificate member 12 and the award member 14, thus facilitating the independence of the certificate member 12 for display and the award member 14 having one or more award seals 22 disposed in relation thereto for redemption or exchange.

In one presently preferred embodiment of the present invention, the connecting means 30 consists of a perforation which assists in the structural separation of the certificate member 12 and the award member 14. It will be readily appreciated by those skilled in the art, however, that other means for separating the certificate member 12 and the award member 14 are possible which are consistent with the spirit and scope of the present invention.

Figure 4:
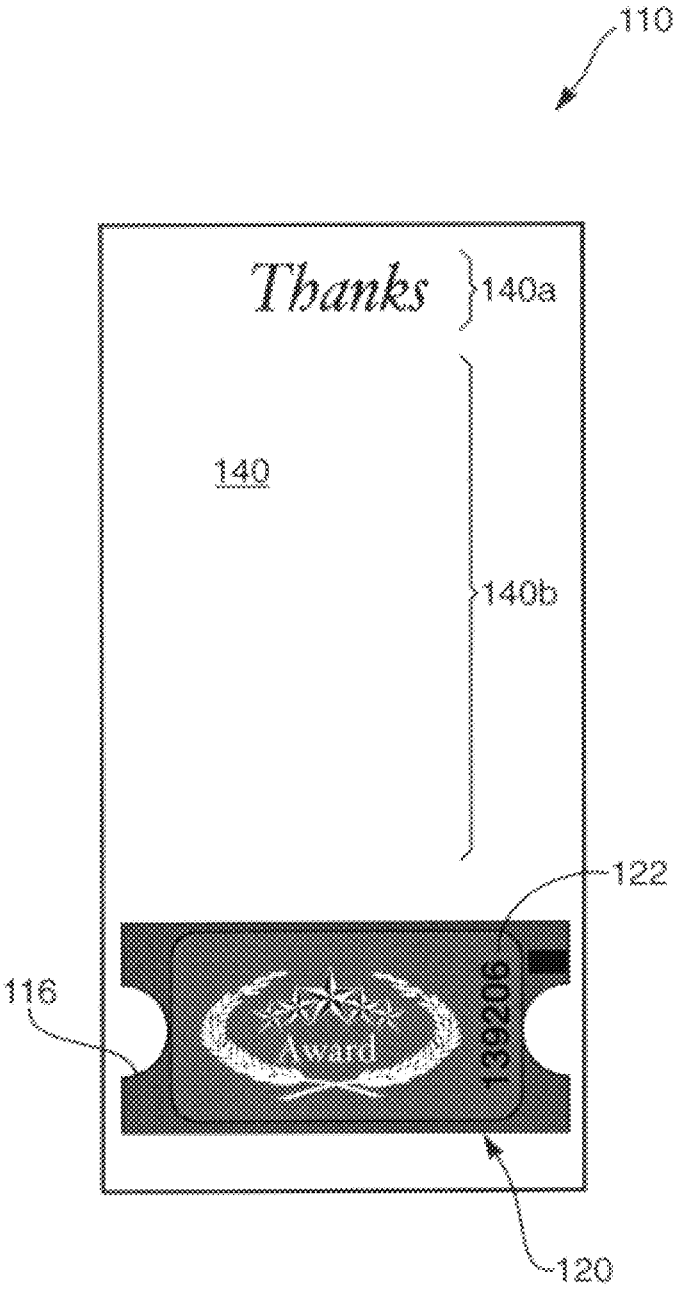
FIG. 4 is perspective view of another presently preferred embodiment of the systems and methods for recognizing and rewarding individual contributions of the present invention.

Another presently preferred embodiment of the present invention, designated generally at 110, is illustrated in FIG. 4. As shown, the recognition assembly 110 comprises a greeting card 140 having a fastening member 116 disposed in relation thereto for removably retaining a retaining member 120 comprising at least one award seal 122. Correspondingly, one or more award seals 122 may be removed from the retaining member 120 and redeemed for selected merchandise and/or services or corresponding value or, in the alternative, saved and introduced into a collection member for accumulating value by means of collecting additional award seals.

In preferred construction, the greeting card 140 may be formed of a material being sufficiently sturdy so as to provide structural support to the card. In one presently preferred embodiment of the present invention, the greeting card 140 may be formed of card stock. As will be readily appreciated by those skilled in the art, however, paperboard, heavy stock paper, composition board, bond paper, or other suitable paper products or materials having sufficient paper weight are possible which are consistent with the spirit and scope of the present invention.

As illustrated in FIG. 4, the greeting card 140 may be formed having a general rectangular configuration, however, those skilled in the art will recognize that various other geometrical configurations are likewise suitable. The use of a generally rectangular configuration is thus by way of illustration and not by way of limitation. In addition, the greeting card 140 may comprise one or more sheets of material. For example, the greeting card 140 may comprise a single sheet of card stock having no bends or creases formed therein. Alternatively, however, the greeting card 140 may include one or more bends or creases so as to provide a bi-fold, quarter-fold, or the like configuration, if desired.

To assist in personalizing the greeting card 140, the layout of the greeting card 140 may comprise a heading or greeting section or field 140*a* (e.g., Thanks, Thank You, Happy Birthday, Merry Christmas, etc.), a section or field for a personalized greeting or message 140*b*, and/or a signature section or field (not shown) which identifies the person or persons presenting the greeting card 140. It will be readily appreciated by those skilled in the art, however, that the incorporation of any one of the sections or fields outlined herein, or the incorporation of other anticipated sections or fields, or any variation thereof, are possible.

Preferably disposed in relation to the surface facing of the greeting card 140 are one or more fastening members 116. As shown, two or more fastening members 116 may be disposed parallel and in a spaced-apart relationship in the surface facing of the greeting card 140 so as to be adapted to engage the retaining member 120 in a substantially fixed or removable relationship therewith. As disclosed above, the structural design of one presently preferred embodiment of the fastening members 116 may be formed as slits, cutouts, tabular members, or the like. As shown, the fastening members 16 may comprise a substantially semicircular configuration, however, other geometrical configurations are possible.

It will be apparent to those skilled in the art that other fastening members, devices, mechanisms, and/or configurations thereof may be constructed in accordance with the inventive principles set forth herein. For example, conventional fastening members or adhesives are herein contemplated to fall within the spirit and scope of the present invention. It is intended, therefore, that the examples provided herein be viewed as exemplary of the principles of the present invention, and not as restrictive to any particular structure or structures for implementing those principles.

The retaining member 120 may be removably disposed in operable engagement with one or more fastening members 116 of the greeting card 140. Consistent with this arrangement, the retaining member 120 comprises means for retaining at least one award seal 122 in relation to the greeting card 140. In one presently preferred alternate embodiment of the recognition assembly 110 of the present invention, the award seal 122 is preferably formed comprising an adhesive backing which removably engages the surface facing (not shown) of the retaining member 120. In operation, after removing an award seal 122 from the retaining member 120, the award seal 122 retains its adhesive characteristics for potential placement into a collection member for the purpose of accumulating award seals, if desired. Similarly, the award seals 122 may include an identification or serial number for administrative purposes and may symbolize various predetermined values for purposes of redemption or exchange value.

Although numerous variations or techniques are available, one presently preferred method for recognizing and rewarding individual contributions of the present invention may comprise the steps of: (1) obtaining a recognition assembly 10, 110 adapted for removably retaining a retaining member 20, 120, the retaining member comprising at least one award seal 22, 122 having a predetermined value and being removable from the retaining member 20, 120; (2) personalizing the certificate member 12 for a qualified recipient, such as, for example, completing the appropriate sections or fields 12*a*, 12*b*, 12*c*, 12*d* provided by the layout of the certificate or, in the alternative, personalizing the greeting card 140 by completing the appropriate sections or fields 140*a*, 140*b* provided by the layout; (3) presenting the recognition assembly 10, 100 to the recipient; and (4) removing one or more award seals 22, 122 from the retaining member 20, 120, respectively, for purposes of redemption. An addition step of one presently preferred method of the present invention may further include the step of separating the certificate member 12 from the award member 14 by means of the detachable connecting member 30 and displaying the certificate of achievement or recognition, for example, in a frame or other suitable display means.

The recipient of the recognition assembly 10, 110 may place one or more award seals 12, 122 removably retained in relation thereto in a suitable collection book to facilitate an aggregation of award seals received. In operation, the recipient may, accordingly, redeem collected award seals in exchange for comparably valued merchandise preferably selected from a catalog of selected merchandise. Award seals may also be redeemed for services which may be rendered by selected businesses, retailers, etc, in exchange for comparably valued award seals. In view of modern communications technology, any number of redemption techniques may correspondingly be aided by way of telephone, facsimile, internet, or other suitable means for communication exchange of valued award seals.

In preface to the foregoing steps of one presently preferred method for recognizing and rewarding individual contributions of the present invention, management or personnel selected to assist in administering the novel systems and methods of the present invention may wish to formulate goals and objectives so as to attempt to target certain desirable behaviors before beginning such a program. Accordingly, the apparatus and methods for recognizing and rewarding individual contributions provides a recognition communication system so as to magnify individual satisfaction and honor positive performance by way of attaching one or more award seals having a redemptive value to a detachable certificate or greeting card to exhibit a means of expressing appreciation.

It will be apparent to those skilled in the art that other protocol, methods, techniques, and/or procedures may be followed in accordance with the inventive principles set forth herein. It is intended therefore, that the foregoing systems and methods be viewed as exemplary of the principles of the present invention, and not as restrictive to any particular apparatus, systems, and/or methods for implementing those principles. As will be appreciated by those skilled in the art, the steps of the presently preferred method as set forth above may be followed out of sequence, and that such an anachronism will not diminish the benefit to be derived therefrom.

From the above discussion, it will be appreciated that the present invention provides novel systems and methods for recognizing and rewarding individual contributions comprising a certificate of achievement or recognition releasably attached to an award member or a greeting card having one or more award seals removably disposed in relation therewith, wherein each award seal comprises a preassigned value which is redeemable for selected merchandise and/or services. In addition, the present invention includes a certificate of achievement or recognition formed of a material sufficiently sturdy to provide structural support to the certificate for display, such as, by way of example, for mounting or framing upon its removable detachment from an award member.

Unlike prior art devices, the present invention provide systems and methods for recognizing and rewarding individual contributions which uses a systematic approach and recognition assembly that is easy to understand, implement, and administer, thus providing a simple turn-key recognition program designed to heighten individual awareness and desire to achieve goals and objectives. Similarly, the present invention incites productivity, safety, morale, quality, and an adherence to established policies and procedures. The present invention further provides a simple construction and few working parts, thus being generally cost effective in relation to mass manufacturing and production.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method for recognizing and rewarding individual contributions, said method comprising the steps of:

obtaining a recognition assembly, said recognition assembly adapted for retaining a retaining member, said retaining member comprising at least one removable award seal having a predetermined value;

personalizing said recognition assembly for a qualified recipient;

presenting said recognition assembly to said qualified recipient;

removing said award seal from said retaining member; and redeeming said award seal for comparably valued merchandise or services.

2. A method for recognizing and rewarding individual contributions as defined in claim 1 further comprising the step of formulating goals and objectives so as to attempt to target certain desirable behaviors from said qualified recipient.

3. A method for recognizing and rewarding individual contributions as defined in claim 1 wherein said recognition assembly comprises a certificate, an award member, and a detachable connecting member disposed therebetween.

4. A method for recognizing and rewarding individual contributions as defined in claim 3 further comprising the step of separating said certificate from said award member by means of detaching said detachable connecting member.

5. A method for recognizing and rewarding individual contributions as defined in claim 4 further comprising the step of displaying said detached certificate.

6. A method for recognizing and rewarding individual contributions as defined in claim 1 wherein said recognition assembly comprises a greeting card.

7. A method for recognizing and rewarding individual contributions as defined in claim 1 wherein said recognition assembly comprises at least one fastening member adapted for retaining said retaining member.

8. A method for recognizing and rewarding individual contributions as defined in claim 1 wherein said valued merchandise and services are selected from a catalog.

9. A method for recognizing and rewarding individual contributions, said method comprising the steps of:

obtaining a recognition assembly comprising a certificate member, an award member, and a detachable connecting member disposed therebetween, said award member adapted to retain a retaining member, said retaining member comprising at least one removable award seal having a predetermined value;

personalizing said certificate member of said recognition assembly for a qualified recipient;

presenting said recognition assembly to said qualified recipient;

separating said certificate member from said award member by means of detaching said connecting member;

removing said retaining member from said fastening member of said award member;

removing said award seal from said retaining member; and redeeming said award seal for comparably valued merchandise or services.

10. A method for recognizing and rewarding individual contributions as defined in claim 9 further comprising the step of formulating goals and objectives so as to attempt to target certain desirable behaviors from said qualified recipient.

11. A method for recognizing and rewarding individual contributions as defined in claim 9 further comprising the step of displaying said certificate member.

12. A method for recognizing and rewarding individual contributions as defined in claim 9 further comprising the step of retaining said award seal in a collection member for accumulation.

13. A method for recognizing and rewarding individual contributions as defined in claim 9 wherein said award member comprises at least one fastening member.

14. A method for recognizing and rewarding individual contributions as defined in claim 9 wherein said valued merchandise and services are selected from a catalog.

15. An apparatus for recognizing and rewarding individual contributions, said apparatus comprising:

a recognition assembly;

a retaining assembly comprising at least one removable award seal;

said award seal having a predetermined value and being redeemable for comparably valued merchandise or services; and a fastening member operably disposed in relation to said recognition assembly, said fastening member adapted to removably retain said retaining assembly.

16. An apparatus for recognizing and rewarding individual contributions as defined in claim 15 wherein said recognition assembly comprises a certificate, an award member, and a detachable connecting member disposed therebetween.

17. An apparatus for recognizing and rewarding individual contributions as defined in claim 16 wherein said certificate is formed of a material sufficiently sturdy for display.

18. An apparatus for recognizing and rewarding individual contributions as defined in claim 17 wherein said certificate comprises a title field, a field identifying a qualified recipient, a field for outlining the nature of recognition, and a field for an authorized signature.

19. An apparatus for recognizing and rewarding individual contributions as defined in claim 15 wherein said recognition assembly comprises a greeting card.

20. An apparatus for recognizing and rewarding individual contributions as defined in claim 15 wherein said valued merchandise and services are selected from a catalog.

* * * * *